United States Patent [19]

Lindgren

[11] 4,127,268

[45] Nov. 28, 1978

[54] TETHERED BALL AND METHOD OF MANUFACTURE

[76] Inventor: Thomas E. Lindgren, 1354 Mich Bluff, San Jose, Calif. 95131

[21] Appl. No.: 738,796

[22] Filed: Nov. 4, 1976

[51] Int. Cl.[2] ..... A63B 43/02; A63B 45/00

[52] U.S. Cl. ..... 273/58 C; 29/432; 29/450; 273/26 E

[58] Field of Search ..... 273/95 A, 95 AA, 58 A, 273/58 C, 98, 99, 26 C, 26 E; 29/433, 432, 450

[56] References Cited

U.S. PATENT DOCUMENTS

| | | | |
|---|---|---|---|
| 667,563 | 2/1901 | Oakley | 273/58 C |
| 1,563,912 | 12/1925 | Miller | 273/58 C |
| 2,040,522 | 5/1936 | Marx | 273/58 C |
| 3,297,321 | 1/1967 | Kuhnes et al. | 273/95 A X |
| 3,332,686 | 7/1967 | Frost | 273/58 C X |
| 3,843,126 | 10/1974 | Bandy | 273/95 A |

*Primary Examiner*—George J. Marlo
*Attorney, Agent, or Firm*—Harry E. Aine; Harvey G. Lowhurst

[57] ABSTRACT

A return ball toy wherein a resilient hand-held ball is tethered at the end of an elastic tape, the other end of which is attached to the wrist of a player. The tape is affixed to the ball by passing the tape through a first hole in the ball from one side of the ball so that a free end of the tape extends beyond the hole on the opposite side of the ball. The free end is then looped and passed through a second hole in the ball from the opposite side of the ball. This forms a tight friction bond between the tape and the resilient interior of the ball.

By utilizing a tape elastic material, the tape can be comfortably tied around the wrist without the need for a separate more elaborate wrist band.

15 Claims, 11 Drawing Figures

TETHERED BALL AND METHOD OF MANUFACTURE

BACKGROUND OF THE INVENTION

1. Field of the Invention

The invention relates to a novel return ball toy having a hand-held resilient ball attached to an elastic cord and to the method of manufacturing the toy.

2. Prior Art

A major problem in the manufacture of action toys involving a resilient ball attached to a resilient cord is the provision of means for attaching the resilient cord to the ball so that the ball will not separate from the cord during use. Prior methods of manufacturing have utilized two general approaches.

The first approach is to manufacture the ball and the elastic cord together so that the cord is made an integral part of the interior of the ball during manufacture. This technique tends to be expensive and limits the choice of materials that can be used for the ball and the resilient cord. That is, the two materials must be compatible for the vulcanization process used to fuse the cord to the ball.

The second general approach is to attach the resilient cord to the ball by some means such as a clip or staple or by passing the cord through the ball and knotting the end of the cord. The disadvantage of utilizing a clip is that should the clip become dislodged or be exposed through the ball through normal use, injury could occur especially to small children using the toy. If an external staple or a knot is used to secure the end of the cord which has been passed through the ball, this not only creates an unsightly condition but also interferes with the handling of the ball.

SUMMARY OF THE INVENTION

It is an object of the invention to provide a method and means for attachment of a resilient cord to a hand-held resilient ball to thereby provide a secure connection.

It is also an object of this invention to provide a method and means of attaching a resilient cord to a ball with minimum interference with the natural contour of the surface of the ball.

Briefly, the above objects are accomplished in accordance with the invention by utilizing a fabric braided resilient tape to tether a return ball. The tape is affixed to the elastic ball by passing the tape through a first hole in the ball from one side of the ball so that the free end of the tape extends beyond the hole on the opposite side of the ball. The free end of the tape is then looped back and passed through a second hole in the ball, which hole is adjacent to the first hole. Since a tape rather than a cord is utilized, which tape has a relatively rough fabric surface, a large amount of friction area exists between the tape and the ball where the tape contacts the interior of the ball and there it loops from one hole to the other on the exterior of the ball. This provides a very secure connection which is simple to manufacture and creates a minimum disturbance with the surface of the ball.

Since the tether is made of a fabric braided tape, there is no need for a special strap to connect the tape to the wrist of the user. By eliminating the need for a metal clip or staple to hold the elastic tape to the ball, a manufacturing step is eliminated along with the danger of injury to the user of the ball.

The foregoing and other objects, features and advantages of the invention will be apparent from the following more particular description of the preferred embodiments of the invention as illustrated in the accompanying drawings.

DESCRIPTION OF THE PREFERRED EMBODIMENTS

Referring now to FIGS. 1*a*–1*f*, a first method by which a tethered ball may be constructed will be described. The ball 10 is made of a suitable resilient material such as rubber or plastic and is substantially solid. The diameter *d* of the ball is chosen to fit the particular application, for example, for a hand-held ball the diameter *d* may be equal to two and one-fourth inches.

A resilient tape 12 is provided as a tether for the ball. This tape is made of a braided resilient material which may be approximately one-fourth of an inch in width with a one to one and one-half stretch ratio. A typical elastic tape is made of polyester rubber covered with a woven or braided fabric. The tape is known in the trade as "polyester flat braided elastic" and can be stitched to fabric for waistbands, sleeves, necklines and legbands of garments. The braided fabric tape chosen should have a relatively high coefficient of friction.

A needle 14 is provided with an eye therein into which the tape 12 can be inserted. The tape 12 is inserted in the eye of the needle 14 and pulled through to a length *l*, which should be approximately 1 inch for a 2¼ inch diameter ball.

Figure 1A:
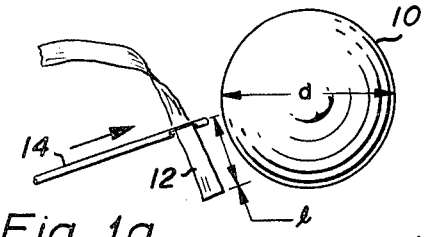
FIGS. 1*a*–1*f* are a sequence of diagrams illustrating a first embodiment of the invention showing the method by which a tethered ball is made.
Figure 1B:
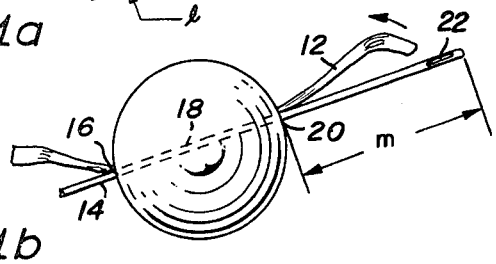

Referring to FIG. 1*b*, the needle 14 is inserted into the ball to thereby puncture the ball at one side 16 of the ball punching a hole 18 through the core of the ball and exiting on the opposite side 20 of the ball. The tape 12 will be pulled through the ball by the needle and stretched. At this point for the most efficient operation, the length of the needle *m* which protrudes through the ball becomes critical. Since the elastic tape has a 1 to 1½ stretch ratio *k* of 1.5, the one inch length of tape, *l*, will stretch to one and one-half inches before the end comes out of the hole 18 on the side 20. Thus, if the needle length *m* is made greater than one and one-half inches the tape 12 will come out of the hole. If the needle is drawn further through the hole up to the point where it exceeds two lines *l* (or two inches in the example), the end of the tape will retract and be pulled free of the eye of the needle 22. Thus, the length *m* should exceed 2*l* or two inches and a suitable length would be two and three-quarter inches.

Figure 1C:
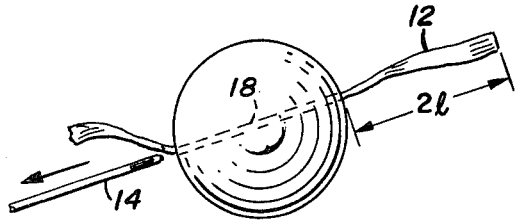

Referring to FIG. 1*c*, the length of tape 12 extending beyond the hole 18 is approximately 2*l*. The needle 14 is at least partially extracted from the hole 18 as indicated by the arrow. It is not necessary to completely remove the needle from the hole 18 in order to perform the following steps.

Figure 1D:
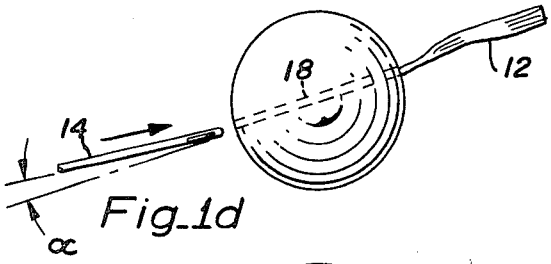
Figure 1E:
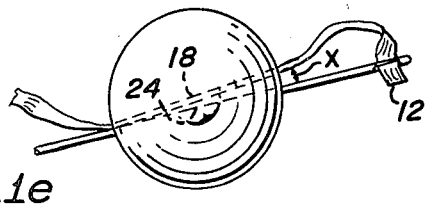
Figure 1F:
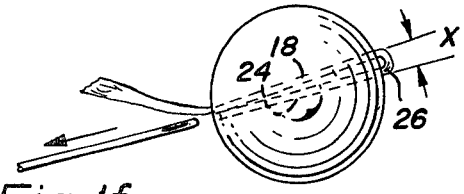

Referring to FIG. 1*d*, the needle 14 is tilted at a slight angle $\alpha$ and reinserted in the ball to form a second hole 24 which is adjacent to the first hole 18 but spaced a distance x therefrom. A suitable distance might be, for example, one-half inch. Next, the end of tape 12 is reinserted into the eye of the needle and the needle is extracted from the hole 24 as shown in FIG. 1*f* pulling the end of tape into the second hole. This leaves a loop of tape 26 on the outside surface of the ball.

Figure 2A:
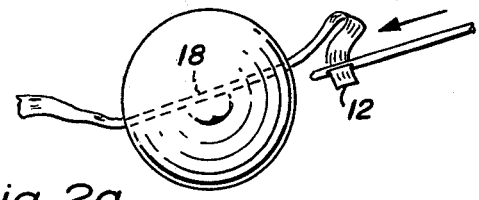
FIGS. 2*a*–2*c* are a sequence of diagrams illustrating a second embodiment of the invention.
Figure 2B:
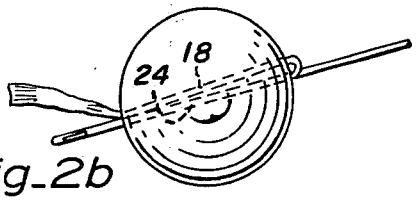
Figure 2C:
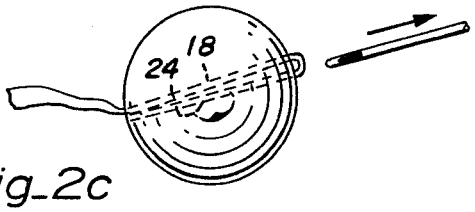

An alternative method can be used to insert the loose end of tape 12 (FIG. 1*d*) into the ball in a second hole as shown by FIG. 2*a*. In FIG. 2*a*, the loose end of tape 12 is inserted by inserting the needle from the opposite side of the ball from that shown in FIG. 1*d* but at the same angle $\alpha$ to thereby provide a second hole 24 adjacent to the first hole 18. As shown in FIG. 2*b*, the end of tape 12 will become disengaged from the needle inside the ball and the needle can be extracted from the ball as shown by the arrow in FIG. 2*c*, or the needle can pass through the ball and out the other side.

Figure 3:
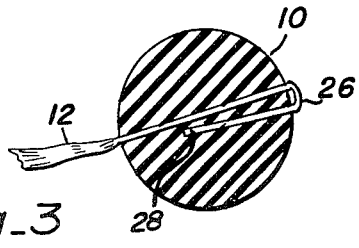
FIG. 3 is a cross section of a tethered ball constructed in accordance with the present invention.

Referring to FIG. 3, a cross section of the ball 10 is shown. The tape 14 passes through the first hole in the ball, forms a loop 26 at the opposite side of the ball and re-enters the ball through the second hole. The end 28 of the loop is therefore embedded in the interior of the ball so that no loose ends extend from the ball.

As an alternative, however, if the original length *l* of tape shown in FIG. 1*a* is made long enough, the end 28 shown in FIG. 3 will protrude from the ball and can be fastened by sewing or gluing to the tape 12. In practice, however, this step becomes unnecessary as there is sufficient friction between the surface of the tape 12 and the interior surface of the ball and at the loop 26 to prevent the tape from being pulled from the ball under even the most strenuous use conditions.

Figure 4:
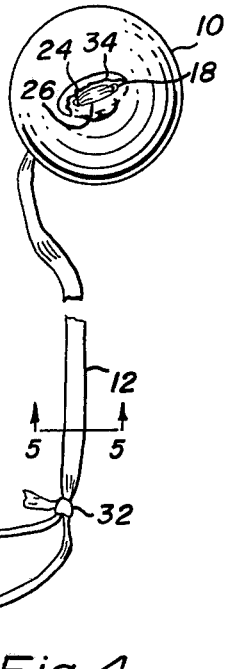
FIG. 4 is a diagram of a complete tethered ball toy constructed in accordance with the invention and showing the tape loop covering material broken away.
Figure 5:
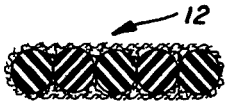
FIG. 5 is a sectional view of the structure of FIG. 4 taken along line 5—5 in the direction of the arrows.

Referring to FIG. 4, the finished product is shown. The tape 12 is shown with a wrist loop 30 therein either tied with a knot, sewn or fastened with a snap or buckle to the tape at a point 32. The tape 12 enters the ball 10 and protrudes from the holes 18 and 24 forming a loop 26. Due to the tension on the tape and the resilience of the ball, the loop 26 will be slightly indented into the surface of the ball so that it can be covered by a piece of protective material shown by the dotted lines 34. For example, a mylar sticker with the name of the product can be placed over the loop 26 to thus leave a smooth surface of the ball. As an alternative, the indentation where the loop 26 occurs can be filled with a filler material or the entire surface of the ball can be refinished with a thin elastic layer to improve the appearance of the ball and to add structural rigidity.

While the invention has been particularly shown and described with reference to preferred embodiments thereof, it will be understood by those skilled in the art that various changes in form and details may be made therein without departing from the spirit and scope of the invention.

What is claimed is:

1. The method of affixing a stretchable tape to a compressible resilient ball comprising the steps of:

a. passing said stretchable tape having a width substantially greater than its thickness and with a fabric covering thereon through a first hole in said ball from one side of the ball so that a free end of said tape extends beyond said hole on a side of said ball opposite said one side;

b. looping the free end of said tape and;

c. passing said free end of said tape through a second hole being adjacent to said first hole, said tape having a sufficiently high coefficient of friction with the inside wall of the holes through which said tape passes such that said tape is securely affixed to said ball essentially only due to the frictional engagement between said ball and said tape.

2. The method according to claim 1 comprising the further step of:

covering the looped free end of said tape where it passes over the surface of said ball from said first hole to said second hole to thereby smooth the contour of the surface of said ball.

3. The method of affixing a stretchable tape to a compressible resilient ball comprising the steps of:

a. passing a needle with said stretchable tape, having a width substantially greater than its thickness and being covered with a fabric, attached through said ball from one side of the ball so that a free end of said tape extends beyond the side of said ball opposite said one side; and b. passing a needle with said free end of said tape attached through said ball, from the side of said ball opposite said one side, such that a loop of tape is created extending over the surface of the ball, said tape having a sufficiently high coefficient of friction with the inside walls of the holes through which said tape passes such that said tape is securely affixed to said ball essentially only due to the frictional engagement between said ball and said tape.

4. The method according to claim 3 comprising the further step of:

covering the loop of tape where it passes over the surface of said ball to thereby smooth the contour of the surface of said ball.

5. The method of affixing a stretchable tape to a compressible resilient ball comprising the steps of:

a. threading said tape, having a width substantially greater than its thickness and being covered with fabric, through an eye of a needle so that a length of tape protrudes therefrom;

b. inserting said needle into said ball so that said needle with tape attached punches through said ball at an entry point on one side of the ball, and exits at a first point on an opposite side of said ball, the needle forming a first hole in said ball;

c. causing said tape to be removed from the eye of said needle;

d. at least partially removing said needle;

e. inserting said needle into said ball so that it passes through a second hole in said ball which is adjacent to said first hole;

f. threading the end of said tape through the eye of said needle; and g. withdrawing said needle so that the end of said tape is drawn into said second hole, said tape having a sufficiently high coefficient of friction with the inside walls of the holes through which said tape passes such that the tape is securely affixed to said ball essentially only due to the frictional engagement between said ball and said tape.

6. The method in accordance with claim 5 wherein in step (a) the length of tape which protrudes through the eye of said needle is equal to *l* and in step (b) the needle is caused to extend at least a distance *m* on the opposite side of said ball wherein *m* is at least equal to *kl*, where $k$ is the stretch ratio of said tape, so that the end of the tape is drawn free of said first hole.

7. The method of affixing a stretchable tape to a compressible resilient ball comprising the steps of:

a. threading said tape, having a width substantially greater than its thickness and being fabric covered, through an eye of a needle so that a length of tape protrudes therefrom;

b. inserting said needle into said ball so that said needle with tape attached punches through said ball at an entry point on one side of the ball, and exists at a first point on an opposite side of said ball, the needle forming a first hole in said ball;

c. causing said tape to be removed from the eye of said needle;

d. threading the end of said tape through the eye of a needle;

e. inserting said needle into said ball from said opposite side so that it passes through said ball forming a second hole which is adjacent to said first hole; and f. withdrawing said needle so that the end of said tape is embedded in said second hole, said tape having a sufficiently high coefficient of friction with the inside walls of the holes through which said tape passes such that the tape is securedly affixed to said ball essentially only due to the frictional engagement between said ball and said tape.

8. The method in accordance with claim 7 wherein in step (a) the length of tape which protrudes through the eye of said needle is equal to $l$ and in step (b) the needle is caused to extend at least a distance $m$ on the opposite side of said ball wherein $m$ is at least equal to $kl$, where $k$ is the stretch ratio of said tape, so that the end of the tape is drawn free of said first hole.

9. A return ball toy comprising:

a resilient ball;

an elastic tape, of a width substantially greater than its thickness and having a frictional fabric covering thereon, said tape extending through a first hole in said ball and passing through a second hole adjacent said first hole in said ball to thereby form a loop of tape at the surface of said ball; and a wrist strap formed by a loop in said tape at the end of said tape opposite the end which is attached to said ball, said tape having a sufficiently high coefficient of friction with the inside walls of the holes through which said tape passes such that the tape is securedly affixed to said ball essentially only due to the frictional engagement between said ball and said tape.

10. The combination in accordance with claim 9 further comprising means for covering said loop of tape at the surface of said ball to thereby form a continuous and noninterrupted surface.

11. A return ball toy comprising:

a resilient ball; and an elastic tape, having a width substantially greater than its thickness and covered with a fabric, extending through a first hole in said ball, and passing through a second hole adjacent said first hole in said ball to thereby form a loop of tape at the surface of said ball, said tape having a sufficiently high coefficient of friction with the inside walls of the holes through which said tape passes such that the tape is securedly affixed to said ball essentially only due to the frictional engagement between said ball and said tape.

12. The combination in accordance with claim 10 further comprising means for covering said loop of tape at the surface of said ball to thereby form a continuous and noninterrupted surface.

13. The combination in accordance with claim 11 wherein said tape comprises polyester flat braided elastic.

14. The combination in accordance with claim 13 wherein said return ball further comprises:

a wrist strap formed by a loop in said tape at the end of said tape opposite the end which is attached to said ball.

15. The product made by the method of claim 1.

* * * * *